109-49.5 SR
12/23/86 XR 4,630,411

United States Patent [19]

Sälzer

[11] Patent Number: 4,630,411

[45] Date of Patent: Dec. 23, 1986

[54] EXPLOSIVE ACTION INHIBITING GLAZING

[76] Inventor: Heinrich Sälzer, Industriestrasse 4, 3550 Marburg-Wehrda, Fed. Rep. of Germany

[21] Appl. No.: 632,444

[22] Filed: Jul. 19, 1984

[30] Foreign Application Priority Data

Jul. 28, 1983 [DE] Fed. Rep. of Germany ..... 3327155
Jun. 5, 1984 [DE] Fed. Rep. of Germany ..... 3420883

[51] Int. Cl.[4] ..... E04H 9/00; E06B 5/12

[52] U.S. Cl. ..... 52/1; 52/202; 109/27; 109/49.5

[58] Field of Search ..... 109/26, 27, 49.5, 68, 109/81; 52/1, 202, 203, 209, 235, 303, 304, 461, 790

[56] References Cited

U.S. PATENT DOCUMENTS 1,703,230 2/1929 Gillar ..... 52/209
2,989,787 6/1961 Smith ..... 52/1
3,193,061 7/1965 Downes ..... 52/461
3,555,736 1/1971 Koch, Jr. et al. ..... 52/209
3,855,898 12/1974 McDonald ..... 104/49.5

FOREIGN PATENT DOCUMENTS 103742 2/1966 Denmark ..... 52/203
2331332 12/1974 Fed. Rep. of Germany ..... 52/304
224774 8/1968 U.S.S.R. ..... 52/1

*Primary Examiner*—Gary L. Smith
*Assistant Examiner*—Neill Wilson
*Attorney, Agent, or Firm*—Arthur B. Colvin

[57] ABSTRACT

An explosive action inhibiting glazing formed of at least two glass units supported in separate frames. The frames define an intervening space therebetween. The space is connected to the environment external of the outer pane by passages which are either open or which are readily opened to permit the rapid reduction of pressure in the space between the frames. The passages leading to the space may be covered by snap-fitted sections intended to blast clear and open the passage responsive to pressure increases within the space between the frames.

3 Claims, 4 Drawing Figures

EXPLOSIVE ACTION INHIBITING GLAZING

Figure 1:
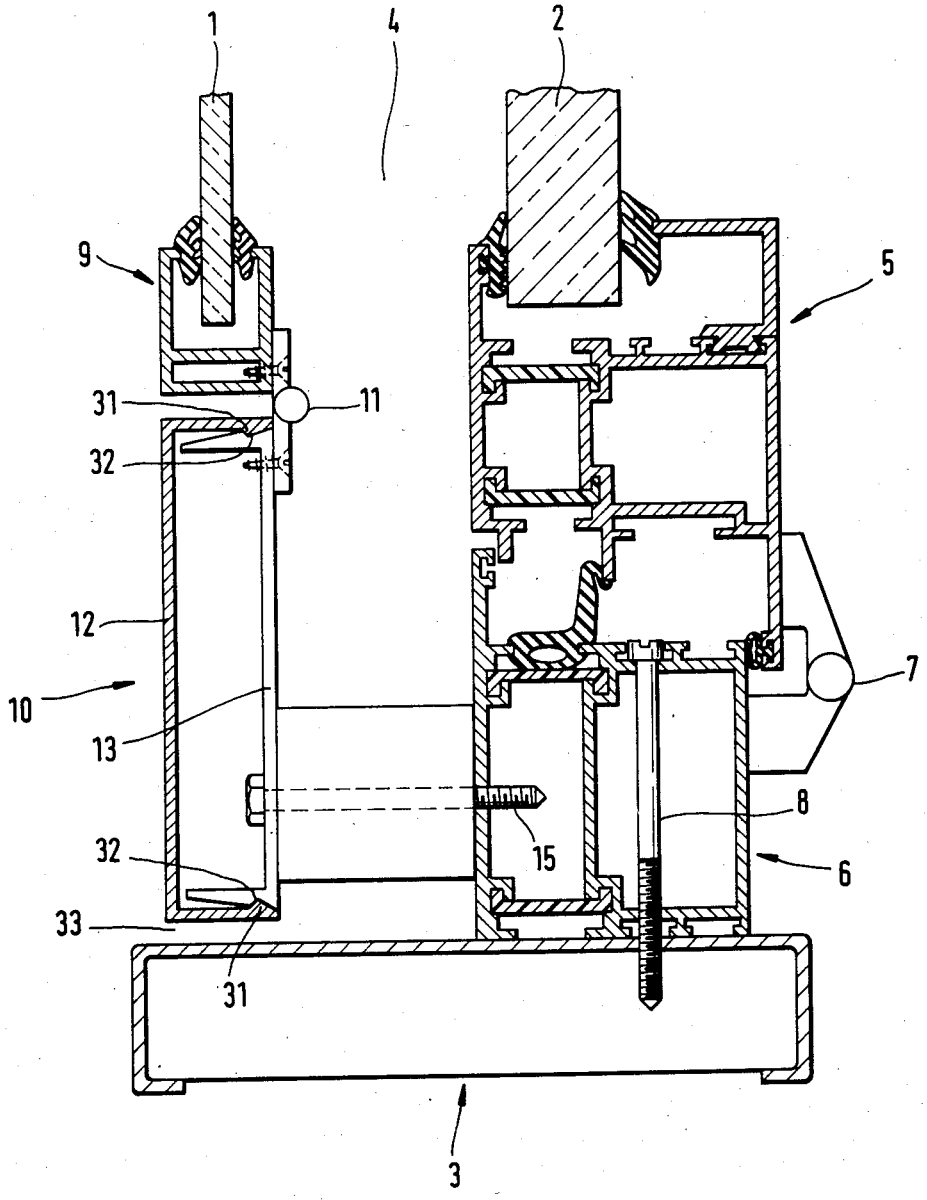

The invention relates to an explosive action inhibiting glazing of at least two glass units arranged with an air gap between them and each surrounded by a closed frame.

For such glazing the use of laminated glass panes is known. The laminated glass units known until now, however, do not meet the extreme requirements for explosion-proof glazings. In fact, if an explosion hit an explosive charge is applied directly in the area of the outside of the window, explosion pressures result which destroy all glass units of the glazing, thus leaving the window opening unprotected.

From DE-OS No. 30 34 833 is known also an explosive action inhibiting glazing of laminated glass with the special feature of improved resistance to explosion pressures. The improved resistance is achieved in that the glazing comprises at least two laminated glass units with an air gap between them, each surrounded by a closed frame of steel sections of L-shaped cross-section, the leg of the frame projecting into the end face being arranged on the side away from the explosive action and leaving between the inner faces of the steel frame and the glass surfaces a gap of at least 10 mm which is filled with a permanently elastic plastic of a Shore hardness of at least 25° Shore and at most about 60° Shore.

The improved explosive action inhibition achieved with the known glazing is attributed to the fact that at the same time a flexible intermediate layer of a minimum thickness of 10 mm is arranged between the high-strength frame and the laminated glass pane. By this elastic intermediate layer there is to be achieved, as it were, a sprung bearing for the laminated glass pane, which is said to be especially favorable and effective in particular at the extremely high and brief explosive pressures. In the known glazing special importance is given in particular also to the arrangement of an air gap between two laminated glass units, because thereby the pressure wave occurring in an explosion is greatly damped.

However, it has been found in tests that although a sprung bearing for laminated glass panes in conjunction with the arrangement of an air gap between two glass units damps the pressure wave occurring in an explosion as compared with conventional glazings, it does not give sufficient assurance that if an explosive charge is applied directly on a glass unit, the pressure wave occurring in an explosion will nevertheless destroy also the glass unit arranged at a distance therebehind, because despite the damping effect even the reduced pressure is still so great that the glass unit cannot withstand it. It is, of course, possible to make the dimensions of the glass units such and to increase their number and the air gap between them so that the glazing withstands even a pressure wave which is barely damped. But the cost that this involves is so high that it is economically unacceptable.

It is the object of the invention to propose a glazing of the initially named kind which does not require individually extremely resistant glass units to ensure a very high explosive action inhibition.

To solve this problem, an explosive action inhibiting glazing of the species named in the preamble of claim 1 is created which presents, according to the invention, the features named in the characterizing part of claim 1.

Due to the openings according to the invention, which may be closed with easily detachable coverings, there results in an explosive hit a connection of the space between two glass units with the space situated on the attack-endangered side, so that the pressure occurring in an explosion is indeed able to destroy the glass unit toward the attack-endangered side, but thereby the pressure peak is reduced, so that the maximum pressure cannot exert itself on the next following glass units, the more so as a compression of the air cannot come about in a degree endangering the next following glass units inside the space between two glass units because of the openings.

The glazing of the invention makes it possible even to arrange the glass units toward the side not endangered by attack in a pivotable or rotatable frame, so that these glass units can be displaced in such a way that the openings actually provided for pressure relief can be made use of for room aeration.

According to a variant of the invention, the openings are provided in the frame of the glass unit associated with the attack-endangered side, and/or between this frame and the embrasure frame.

Due to this design, the embrasure frame, which may also be made of masonry, requires no machining or treatment to accommodate the openings. The openings, which may have the form of slots or slits, do not require any additional machining of the frame of the glass unit either, if they are provided according to the invention between this frame and the embrasure frame.

Preferably the frame—presenting the openings and/or limiting the openings—of the glass unit toward the attack-endangered side consists of frame segments which are connected via spacers with the frame of the adjacent glass unit or with the embrasure frame, the frame segments being able to form closures of additional openings.

Through this design a frame in the manner of a window frame can be fitted together from frame segments around the glass unit toward the attack-endangered side, which frame is connectable through the spacers with the frame of the adjacent glass unit or with the embrasure frame. The frame segments may be dimensioned so that between them and the embrasure frame gap-like openings remain, through which the space between two glass units is connectable with the space on the attack-endangered side. The two spaces are given an enlargeable connecting cross-section if the frame segments are connected with the spacers in an easily detachable manner, so that they will blast off under an explosive pressure and thus constitute closures of additional openings.

According to a further variant of the invention, the frame segments may consist of substantially U-shaped cover sections forming a window frame, which cover sections are detachably retained through clamping elements fastened on the spacers or made in one piece with them.

Due to this design, a relatively low pressure between the glass unit toward the attack-endangered side and the next following glass unit suffices to reduce this pressure abruptly through detachment of the frame segments from the spacers, unless it is reduced through the openings present anyway between the window frame and the embrasure frame.

Unlike the U-shaped cover sections, the clamping elements are fixed on the spacers, so that, at clamping elements of frame segments forming a leg of a window frame, straps articulatedly connecting the frame of the respective glass unit may be attached.

By this design it is even possible to provide the glass unit toward the attack-endangered side with a pivotable or rotatable frame, which preferably is of smaller dimensions as compared with the frame of a following glass unit by an amount such that also the glass unit toward the attack-endangered side can be swung into the interior of the building, for example for cleaning purposes.

Each clamping element fastened via a spacer to the embrasure frame or to the frame of the next following glass unit, or made in one piece with the spacer, consists preferably of a substantially U-shaped section which is fastened by its web to the respective spacer or is made in one piece therewith and whose legs toward the attack-endangered side are embraced by legs of the likewise substantially U-shaped cover section.

Through this design the U-shaped cover sections are given a sufficiently stable fixation and yet can be blasted off the clamping elements with sufficient certainty in case of explosion.

Sufficient fixation of the cover sections while preserving the ability to blast off in case of explosion is achieved in particular by the fact that the legs of the sections forming the clamping elements, on the one hand, and the legs of the cover sections forming the window drame, on the other hand, have engaging and disengaging projections and depressions, respectively, on contiguous sides.

Lastly it may be advisable also to arrange pressure elements, introduced under prestress and oriented perpendicular to the plane of the glazing, between the frames and/or between the edge regions of the glass units adjacent to the frames.

These pressure elements, which may consist for example of a telescoping sleeve pair for each with a compression spring arranged therein, are adapted to replace the rigid spacers, so that via the pressure elements the glass unit toward the attack-endangered side together with its frame will, in case of explosion, at first yield elastically counter to the force of the pressure elements, without the possibility of an over-pressure that would endanger the next following glass unit building up between the glass units. Also by this design the peak of a pressure wave can be absorbed, so that under certain circumstances even the glass unit directly facing the attack-endangered side will withstand the explosion, unless the latter results from a so-called sticking charge which was firmly connected with a glass unit directly.

Several embodiments of an explosive action inhibiting glazing according to the invention are illustrated in the drawing.

Figure 2:
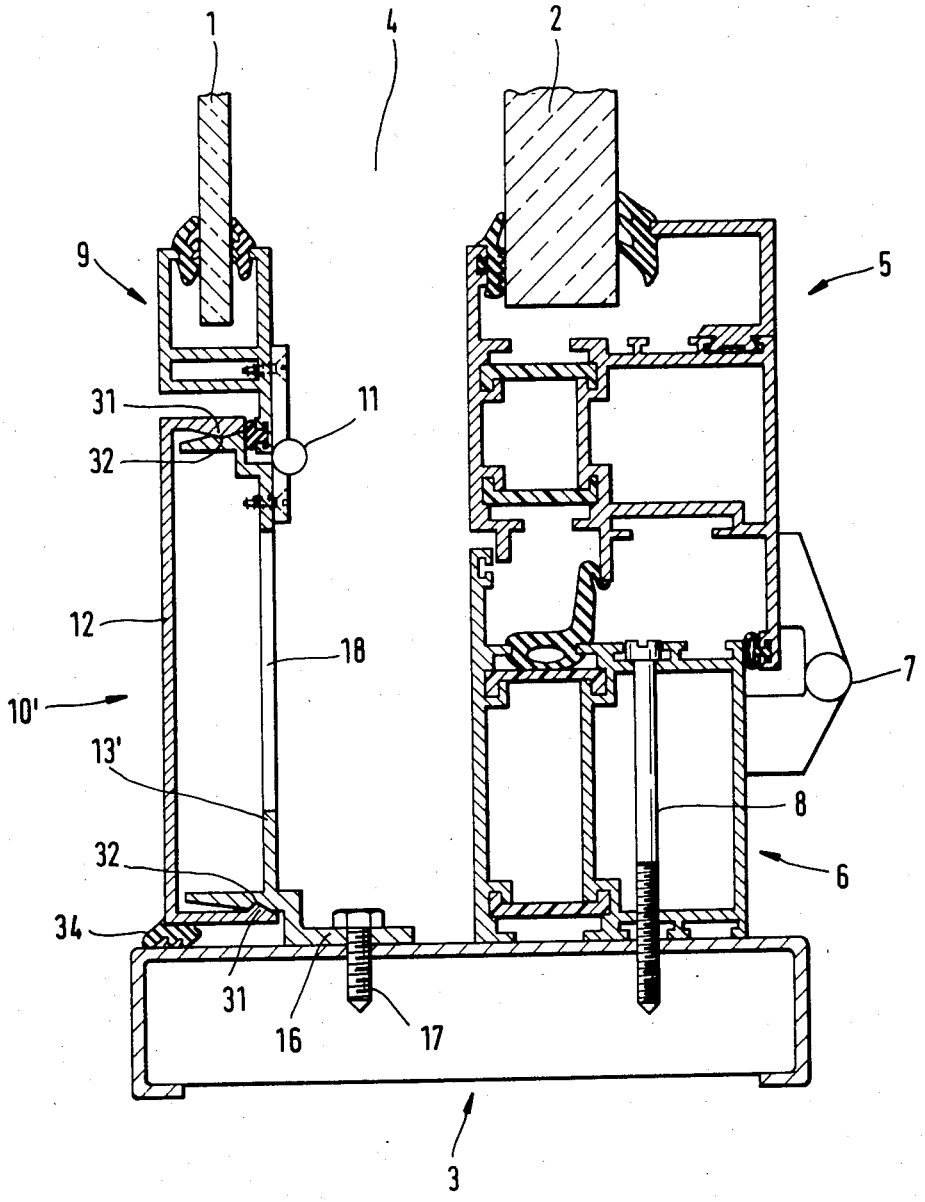
Figure 3:
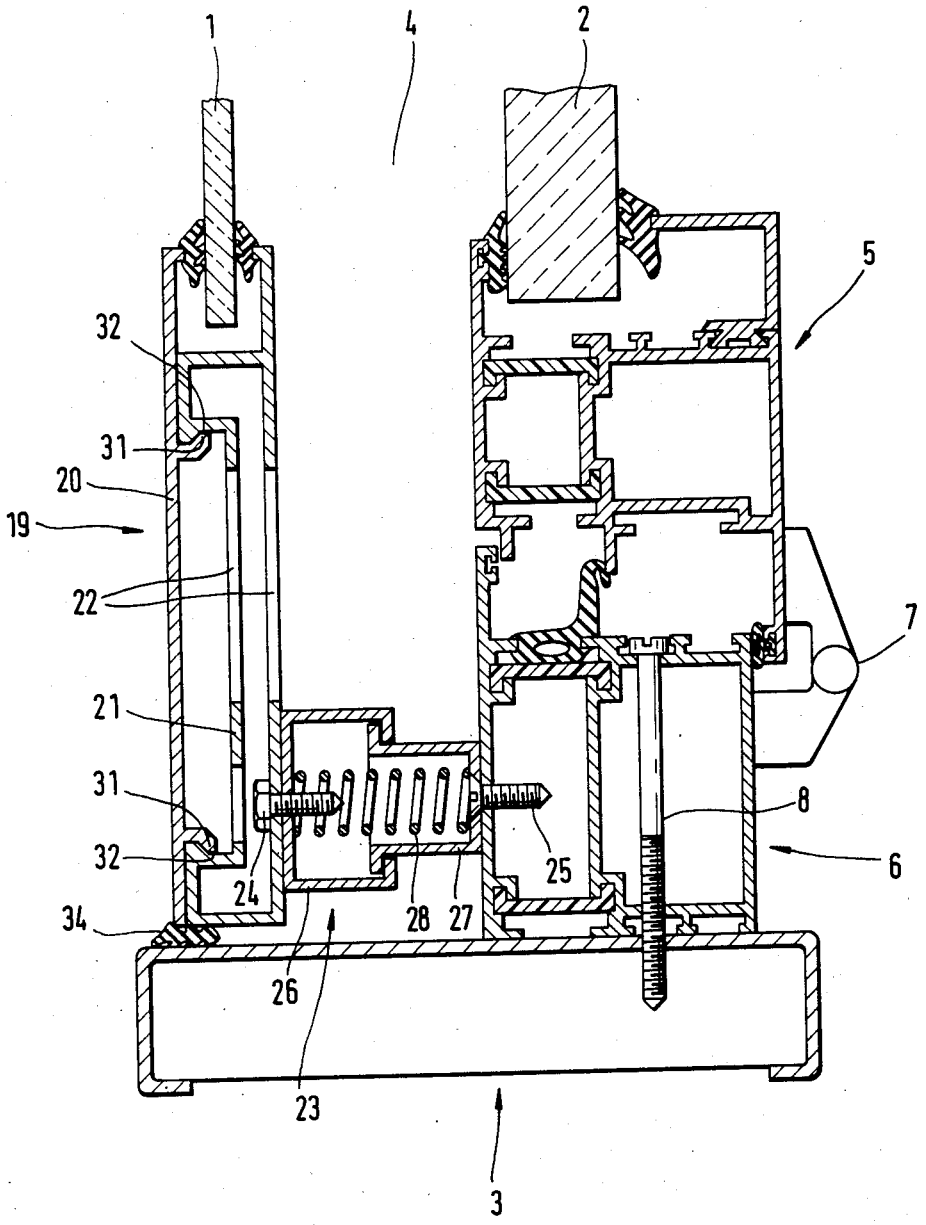

FIG. 1 shows a glazing consisting of two glass units, where a window frame of the glazing toward the attack-endangered side is connected with the window frame of the next following glazing;

FIG. 2, a glazing according to FIG. 1, but where the window frame of the glass unit toward the attack-endangered side is fastened directly to an embrasure frame;

FIG. 3, a glazing consisting of two glass units, the frames of which are connected together by way of spacers formed as pressure elements.

Figure 4:
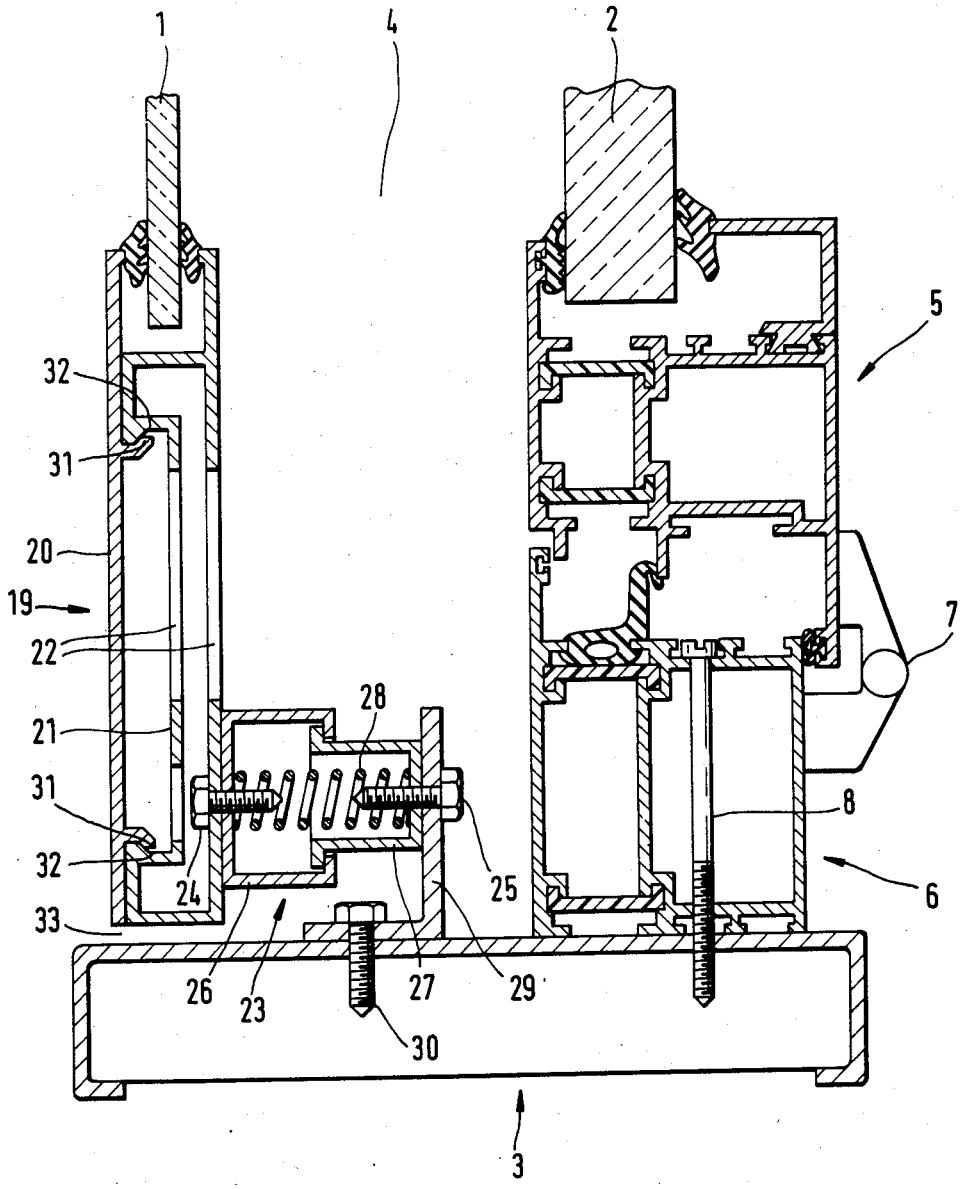

FIG. 4, a glazing according to FIG. 3, but where the pressure elements of the frame of the glass unit toward the attack-endangered side are connected with brackets fastened on the embrasure frame.

The glazings, represented broken away and in cross section, consists of a glass unit 1 toward the attack-endangered side, which may consist for example of polycarbonate, and a glass unit 2 away from the attack-endangered side, which is thicker. The glass units 1 and 2 are arranged inside an embrasure 3 parallel to and spaced from each other, and with the embrasure frame 3 they define a space 4.

In all embodiments the glass unit 2 is consistently provided with a casement frame 5 and a window frame 6, which are articulatedly connected together through straps 7. The window frame 6 is fastened in the embrasure frame 3 by screws 8.

In the embodiments according to FIGS. 1 and 2, the glass unit 1 is provided with a casement frame 9 and a window frame 10, 10', which are articulatedly connected together through straps 11. The window frames 10 and 10' consist of U-shaped cover sections 12, forming frame segments.

In the embodiment according to FIG. 1, the U-shaped cover sections 12 are clamped onto likewise U-shaped sections 13, which are mounted on spacers 14 and are fastened on the window frame 6 of glass unit 2 by screws 15.

In the embodiment according to FIG. 2, the U-shaped cover sections 12 are clamped on likewise U-shaped sections 13', at which are formed brackets 16 and through them fastened directly on the embrasure frame 3 by means of screws 17. In the web portion of the U-shaped sections 13' are provided moreover discontinuities 18, which are advantageous at any rate when the sections 13' exceed a certain length.

In the embodiments according to FIGS. 3 and 4, the glass unit 1 is provided with a fixed frame 19, which likewise consists of U-shaped cover sections 20, which in turn form frame segments. The U-shaped cover sections 20 are clamped in likewise U-shaped sections 21, which in turn are provided in their web portions with discontinuities 22 if they exceed a certain length.

In the embodiment according to FIG. 3, pressure elements 23 are fastened between the sections 21 and the window frame 6 of glass unit 2, by means of screws 24 and 25. The pressure elements 23 consist of two telescoping sleeve parts 26 and 27, wherein a prestressed compression spring 28 is arranged.

In the embodiment according to FIG. 4, the pressure elements 23 are arranged between the sections 21 and brackets 29, which are fastened on the embrasure frame 3 by screws 30.

In all embodiments, the legs of the U-shaped cover sections 12, 20 are provided with projections 31, which engage in depressions 32 of the legs of the U-shaped sections 13, 13' or 21, respectively.

Lastly, in all embodiments the space 4 between glass units 1 and 2 communicates via openings 33 with the space situated on the attack-endangered side, so that no pressure can build up in space 4 that would endanger the glass unit 2. If the cross section of the openings 33, which according to the embodiments of FIGS. 2 and 3 may alternatively be closed by an easily detachable seal section 34, is not sufficient for pressure relief of space 4, the U-shaped cover sections 12, 20 will, at a relatively slight pressure increase in space 4, be blasted off the sections 13, 13' or 21 and will in that way greatly enlarge the connecting cross-section between space 4 and the space on the attack-endangered side of the glazing.

I claim:

1. An explosive action resistance glazing unit comprising an embrasure frame, an inner frame member mounted to said embrasure frame, an inner blast resistant pane mounted in said inner frame member, an outer frame member comprised of a glazing frame having an outer blast resistant pane mounted therein and a surrounding frame supporting said glazing frame, said surrounding frame having an inner section operatively connected to said embrasure frame and an outer section snap fitted connected to said inner section, said panes and frames together defining a space there between, pressure relief passage means extending into said space from the exterior in surrounding relation of said outer pane, said passage means being sized to permit the rapid outflow of gases within said space to thus minimize pressures within said space in response to an explosive inwardly directed force applied against said outer pane, said inner section having passages formed there through in communication with said space, whereby said outer section is released from said snap fitting connection with said inner section to open said passages responsive to pressure build up in said space.

2. An explosive action resistance glazing unit comprising an embrasure frame, an inner frame member mounted to said embrasure frame, an inner blast resistant pane mounted in said inner frame member, an outer frame member mounted on said embrasure frame, telescope means interposed between said outer frame member and said embrasure for enabling movement of said outer frame member toward and away from said inner frame member, spring means biased against said outer frame member and urging said outer frame member away from said inner frame member, an outer blast resistant pane mounted in said outer frame member, said panes and frames together defining a space there between, and pressure relief passage means extending into said space from the exterior in surrounding relation of said outer pane, said passage means being sized to permit the rapid outflow of gases within said space to thus minimize pressures within said space in response to an explosive inwardly directed force applied against said outer pane.

3. A glazing unit in accordance with claim 1 wherein said inner section is secured to said inner frame member.

* * * * *